United States Patent [19]

Krüger et al.

[11] Patent Number: 4,483,575

[45] Date of Patent: Nov. 20, 1984

[54] DEVICE FOR DETACHABLE CONNECTION, PARTICULARLY OF THE ENDS OF HIGH-VOLTAGE TRANSMISSION LINES

[75] Inventors: Manfred Krüger; Franz E. Schulte Strathaus, both of Unna, Fed. Rep. of Germany

[73] Assignee: F.E. Schulte Strathaus KG, Unna, Fed. Rep. of Germany

[21] Appl. No.: 375,281

[22] PCT Filed: Aug. 25, 1981

[86] PCT No.: PCT/DE81/00129

§ 371 Date: Apr. 27, 1982

§ 102(e) Date: Apr. 27, 1982

[87] PCT Pub. No.: WO82/00925

PCT Pub. Date: Mar. 18, 1982

[30] Foreign Application Priority Data

Aug. 28, 1980 [DE] Fed. Rep. of Germany ..... 3032414

[51] Int. Cl.[3] ..... H01R 13/621

[52] U.S. Cl. ..... 339/14 P; 339/92 M; 339/40

[58] Field of Search ..... 339/14 P, 92 R, 92 M, 339/40

[56] References Cited

U.S. PATENT DOCUMENTS

| | | | |
|---|---|---|---|
| 2,610,222 | 9/1952 | Burtt et al. | 339/92 M |
| 2,697,212 | 12/1954 | Castelli | 339/92 M |
| 3,209,302 | 9/1965 | Uberbacher | 339/45 |
| 3,222,631 | 12/1965 | Cohen | 339/40 |
| 4,140,358 | 2/1979 | Marechal | 339/40 |
| 4,179,179 | 12/1979 | Lowden | 339/92 M |
| 4,284,311 | 8/1981 | Forster et al. | 339/40 |

FOREIGN PATENT DOCUMENTS

| | | |
|---|---|---|
| 658827 | 4/1938 | Fed. Rep. of Germany . |
| 682878 | 10/1939 | Fed. Rep. of Germany . |
| 698504 | 10/1940 | Fed. Rep. of Germany . |
| 705485 | 3/1941 | Fed. Rep. of Germany . |
| 1071800 | 12/1959 | Fed. Rep. of Germany . |
| 1151038 | 7/1963 | Fed. Rep. of Germany . |
| 1765826 | 10/1971 | Fed. Rep. of Germany . |
| 2737127 | 1/1979 | Fed. Rep. of Germany . |
| 1040262 | 10/1953 | France . |
| 2051219 | 4/1971 | France . |
| 715152 | 12/1941 | German Democratic Rep. . |
| 372612 | 5/1973 | U.S.S.R. . |

*Primary Examiner*—John McQuade

*Attorney, Agent, or Firm*—Toren, McGeady and Stanger

[57] ABSTRACT

In a device (1) with a plug portion (2) and a socket portion (3) for the detachable connection particularly of the ends of high-voltage transmission lines and of the ends of low-voltage control lines, and with a mechanism for fixing the connection to prevent unintentional separation, a solution is to be provided through which the manipulation of such a coupling (3) is simplified and, particularly, a device (1) of the above-described type is made suitable also for voltages exceeding 500 volts. This is achieved by constructing the fixing mechanism as a drive element (8) which moves the device portions (2,3) relative to one another into the coupled and uncoupled positions and which locks them in the coupled position. It is also provided that socket (3) is equipped with a slide safety mechanism (23) which closes off the socket contacts in the uncoupled position and is moved by a control surface (25) on the plug (2) after an initial engagement of the two device portions into an open position facilitating the coupling.

5 Claims, 3 Drawing Figures

DEVICE FOR DETACHABLE CONNECTION, PARTICULARLY OF THE ENDS OF HIGH-VOLTAGE TRANSMISSION LINES

TECHNICAL FIELD

The invention relates to a device with a plug portion and a socket portion for the detachable connection, particularly of high-voltage transmission lines and of the integrated end of low-voltage control lines, and with a mechanism for fixing the connection to prevent unintentional separation.

BACKGROUND ART

Plug and socket devices of this type are provided, for example, in power lines which serve for the connection of heavy-current load, for example, of strong electric motors in workshops or the like. These devices are known for voltages of up to 500 volts. The coupling can be effected in these cases in such a way that it is secured by means of a kind of bayonet catch. Such a coupling is limited in its application particularly if the coupling is to be intended for connecting lines carrying higher voltages. The couplings then have a comparatively large size and heavy weight and, therefore, are difficult to manipulate.

DISCLOSURE OF INVENTION

It is therefore the object of the invention to provide a solution which simplifies the manipulation of couplings of this type and which particularly makes a device of the above-described type suitable for voltages exceeding 500 volts.

In a device of the above-described type, this object is met in accordance with the invention by constructing the fixing mechanism as a drive element which moves the two portions of the device relative to one another into the coupled or uncoupled positions and locks the portions in the coupled position.

The invention makes it possible to simplify the manipulation of a plug and socket device for high voltages. Particularly, it is no longer necessary to move one of the elements of the device during coupling, i.e., the plug portion or the socket portion; this is quite difficult to do anyhow considering the cable diameters of high-voltage transmission lines.

For a further simplification of the manipulation, a further development of the invention provides that the drive element is arranged in the center of the forces acting on the coupling plug during coupling; in a special embodiment, it may be provided that the drive element is formed by a threaded bolt arranged on one portion of the device and a threaded sleeve which is arranged on the other portion of the device and overlaps the threaded bolt, wherein one of the parts is rotatably mounted in the respective portion of the device in order to effect the coupling or uncoupling movement.

This construction according to the invention makes possible with simple means the application of the coupling forces and of the locking forces desired for maintaining the connection. In addition, by the selection of appropriate thread pitches, a reduction ratio and, thus, a further reduction of the required forces in the drive element can be provided.

In accordance with the invention, it can also be provided that the coupling is equipped with a slide safety mechanism which covers the coupling contacts in the appropriate position and is moved into the open position facilitating the coupling by means of control surfaces on the plug after the two portions of the device have been initially engaged.

In this regard, it can also be provided in accordance with the invention that the control surface is provided on a part of the housing wall which projects beyond the contact pins of the plug and extends in the axial direction of the pins, so that the slide safety mechanism is moved in the open position due to a further relative movement of the portions of the device after this housing wall is engaged in or overlapped over the coupling housing and after the threaded pin is engaged in the threaded sleeve of the drive element.

It has been found advantageous if, as also provided by the invention, during coupling after engagement of the threaded pin with the threaded sleeve, first a grounding pin, then the three-phase plug pins and subsequently the two control pins reach electrically conducting engagement with the coupling. As a result, it is achieved that the grounding pin lags behind the three phases during separation, while the control pins lead them, in order to obtain, for example, a dropping of the load contactor in a control cabinet prior to disconnecting the connection at the housing, i.e., an encapsulation of the coupling.

In accordance with the invention, it can also be provided that the plug and socket have an essentially rectangular housing, with elements arranged next to one another and located on a common center line as seen from the top, wherein the three-phase plug pins are arranged on one side of the drive and centering element and the grounding pin as well as the control pins are arranged on the other side of this element within the housing.

The invention particularly also relates to an above-described device for coupling electric hot plates for a device for the thermal connection of at least two parts, particularly of conveyor belt ends, as they are protected, for example, in German Patentschrift No. 27 27 300 owned by the applicant. Since devices of this type are used especially below ground, the regulations with respect to an operation below ground must be observed, which is especially advantageously done with simple means by means of a coupling of the above-described type.

For adapting the device to this special field of application, in accordance with an embodiment of the invention, it is provided that the plug is integrated in the hot plate, and that the cable outlet is arranged in the region of the heavy-current contact sleeves. This arrangement has been found particularly advantageous in this special field of application.

BRIEF DESCRIPTION OF THE DRAWINGS

Additional features, details and advantages result from the subsequent description with the aid of the drawing. In the drawing.

DETAILED DESCRIPTION OF EMBODIMENTS OF THE INVENTION

Figure 1:
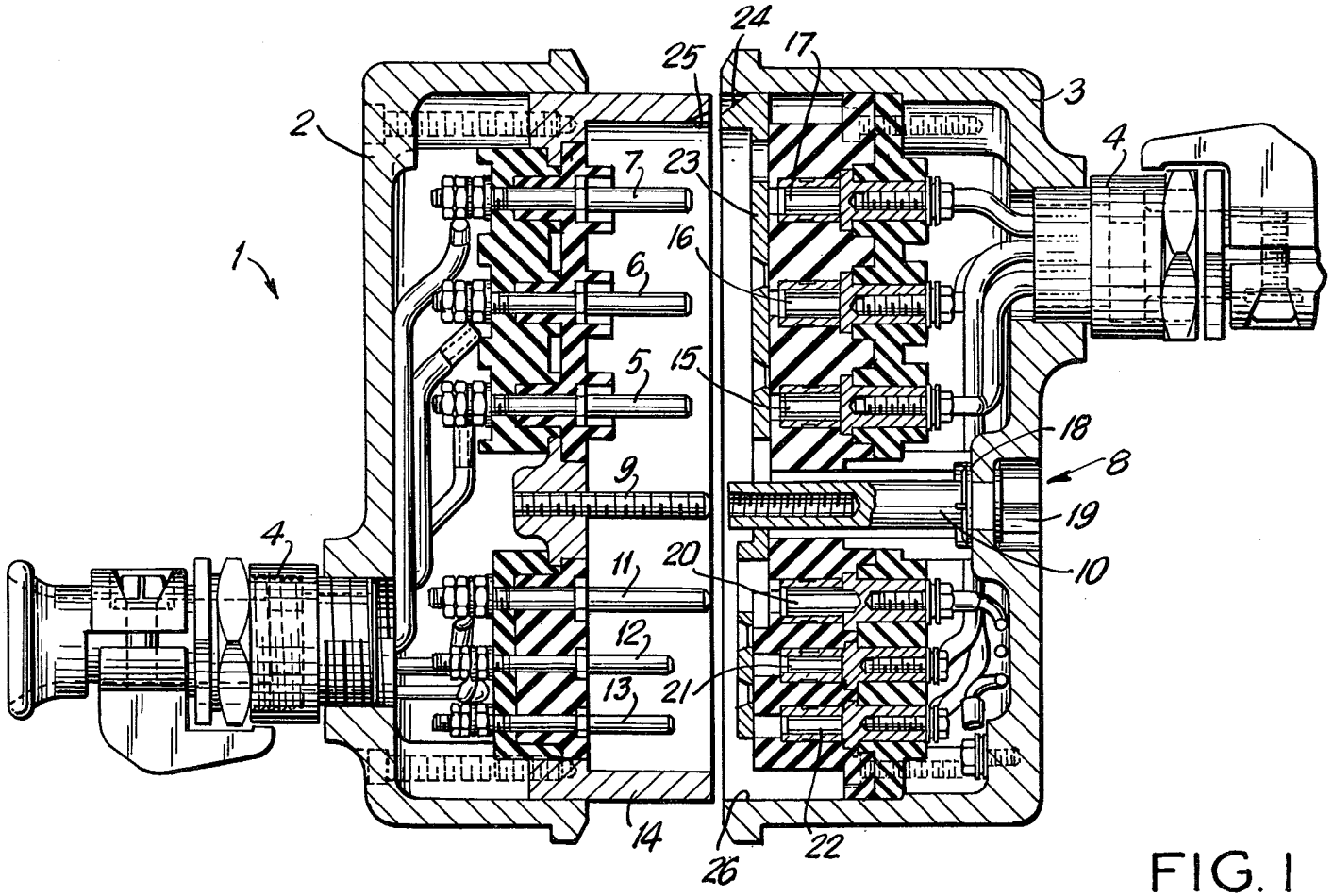
FIG. 1 shows the device composed of a socket and plug in the disconnected state.

The device generally denoted by reference numeral 1 is composed of a device portion 2 and a device portion 3, called plug 2 and socket 3 in the further description. In the illustrated example, the housings consist of metal, for example, cast members of (GCuSN 12). Plug 2 and socket 3 are each provided with a cable inlet 4, the respective cable not being illustrated in detail. Plug 2 and socket 3 are essentially rectangular, so that the elements of the device which come into contact with one another and are described in detail hereinbelow are arranged in a row on an imaginary common center line.

In the illustrated example, the plug 2 has three plug pins 5, 6, 7 for the three heavy-current phases, the plug pins being arranged in the plug 2 in a linear arrangement relative to the other elements on one side of a part of the drive element which is generally denoted by reference numeral 8. In the illustrated example, the part of the drive element 8 in the plug 2 is formed by a threaded pin 9 which is rigidly mounted in the housing and, in the position of use, is overlapped by a threaded sleeve 10 which is arranged in the jacket 3 and will be described in more detail hereinbelow.

A grounding pin 11 and two control pins 12 and 13 are arranged on the other side of the threaded pin 9 in the plug 2 in the same line as the plug pins 5, 6, 7. As can be seen from FIG. 1, a sleeve-like wall portion 14 projects outwardly beyond the plug pins and the control pins approximately by the length of the threaded pin or the grounding pin which has approximately the same length. The threaded pin and the grounding pin are the outwardly longest elements. The three plug pins 5, 6 and 7 are shorter than the threaded pin and the grounding pin, and the two control pins 12 and 13, in turn, are shorter than the plug pins.

The corresponding elements in the socket 3 are arranged in the same linear arrangement as the elements 5, 6, 7, 9, 11, 12, 13 of the plug 2. Cu/Zn-contact sleeves 15, 16, 17 with slotted bores and sleeve springs are located opposite the three-phase plug pins 5, 6, 7. In the coupled position, these contact sleeves 15, 16, 17 impart an increased contact on the plug pins 5, 6 and 7. The threaded sleeve 10 which is arranged rotatably and electrically conducting in a wall portion 18 of the socket housing is arranged next to the contact sleeves 15, 16, 17. To effect its rotation, the threaded sleeve 10 is provided with a head 19 suitable for the application of a wrench or another tool. In addition, contact sleeves 20, 21 and 22 for the grounding pin 11 and the control pins 12 and 13 are arranged next to the threaded sleeve 10 in a common center line.

In the uncoupled position illustrated in FIG. 1, the entry openings corresponding to the sleeves are covered by a plate-shaped slide safety mechanism 23 which is held under the action of a spring in the closed position illustrated in FIG. 1. The slide safety mechanism 23 has on one side a control surface 24 which can be brought in engagement with a control surface 25 on the wall portion 14 of the housing of the plug 2.

The device according to FIG. 1 operates as follows: When the plug 2 and the socket portion 3 of the device 1 are moved toward one another, initially the threaded sleeve 10 comes in engagement with the threaded pin 9 while the plug wall 14 makes contact with the inner surface 26 of the socket housing 3. This already ensures an encapsulation of plug and socket. When the drive element 8 is now actuated, i.e., the threaded sleeve 10 is rotated, the elements are moved toward one another, so that the slide safety mechanism 23 is initially moved into the open position as a result of the contact of the control surfaces 24 and 25. Due to the electrical connection, an initial grounding is effected through the drive element 8. During the following coupling procedure, initially the grounding pin 11 engages the contact sleeve 20, subsequently the three plug pins 5, 6, 7 engage the corresponding contact sleeves 15, 16, 17 and, finally, the control pins 12 and 13 make contact with the contact sleeves 21 and 22. After the conclusion of the coupling movement, the device assumes the closed end position illustrated in FIG. 2 in a modified embodiment.

Figure 2:
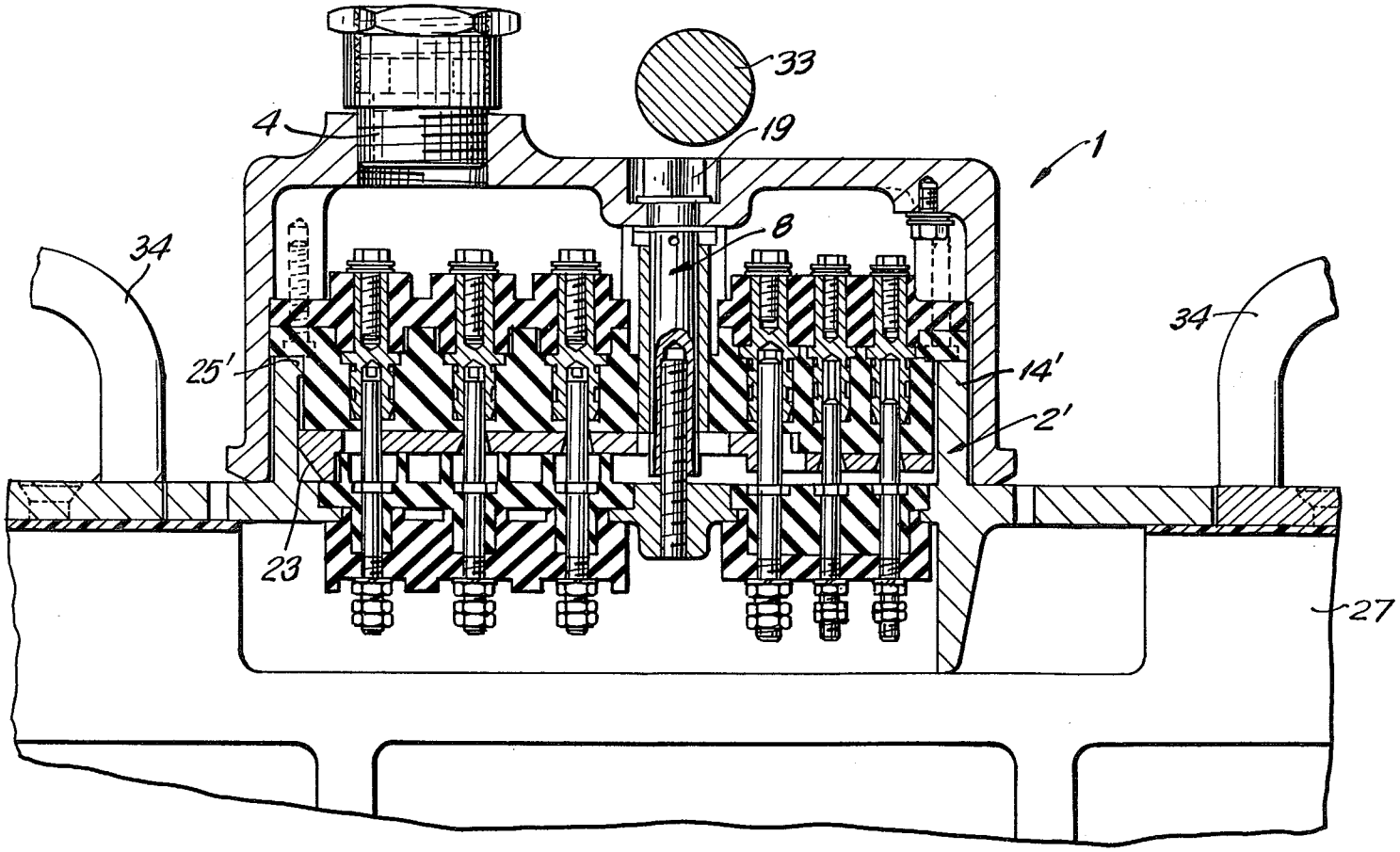
FIG. 2 shows the device in the connected state, wherein the plug portion is an integrated structural component of a hot plate.
Figure 3:
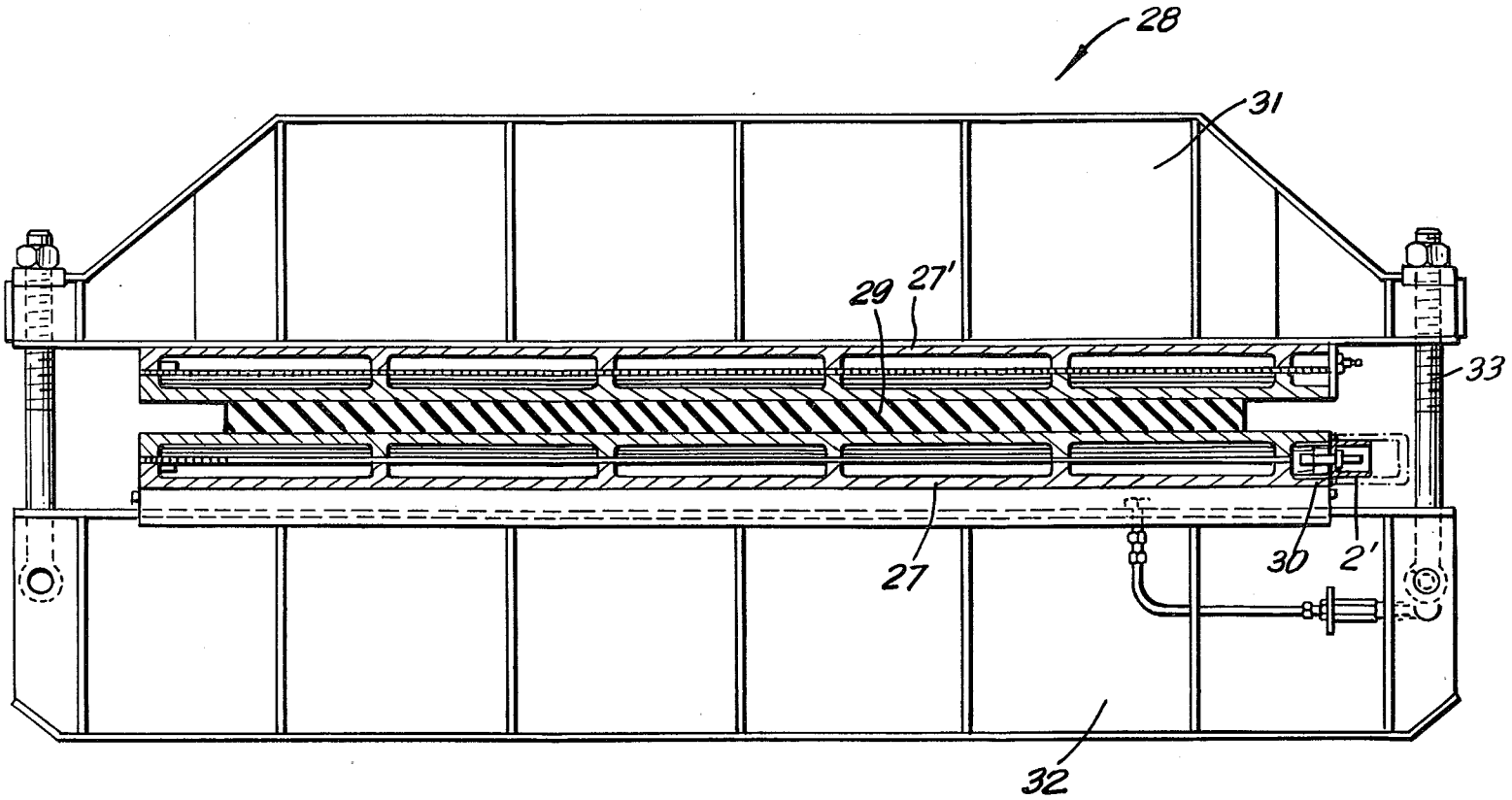
FIG. 3 shows a view of a portion of a device for the thermal connection of conveyor belt ends with a plug arranged in a hot plate and schematically illustrated socket.

FIG. 2 shows the device 1 as a partially integrated structural component of a hot plate 27 of a device for the thermal connection designated by reference numeral 28 in FIG. 3, particularly for the ends of conveyor belts 29.

A plug 2' is integrated in the end face 30 approximately in middle of the plate in such a way that the wall portion 14' engaging the socket and provided with the control surface 25' moving the slide safety mechanism 23 in the socket 3 projects outwardly between two plate grip elements 34 which are only illustrated schematically.

The contacts and electrically conducting elements are cast or encapsulated in the socket or plug and/or in the hot plate region with a silicon rubber substance; this is not illustrated in detail in the figures.

As can be seen from FIG. 3 in conjunction with FIG. 2, the hot plates are braced against one another by cross members 31 and 32 by means of bracing bolts 33 whose position is illustrated in FIG. 2. Preferably, the individual elements are aligned thereby that in the position of use the bracing bolt 33 is located in front of the head 19 of the drive element 8, so that a separation of the connection is not possible when the device is closed.

Of course, the described embodiment can be modified in many respects, without departing from the basic concept of the invention. For example, the invention is particularly not limited to the illustrated rectangular shape of the device, and also not to the number and arrangement of the contact pins. If this should be desirable in larger couplings, it is also possible to provide several drive mechanisms 8 which can be synchronized with respect to their rotation.

We claim:

1. Device with a plug portion (2) and a socket portion (3) for the detachable connection of said plug portion and socket portion, such as for the ends of high-voltage transmission lines, said plug portion (2) having plug pins (5, 6, 7) therein arranged in spaced relation, said socket portion (3) having socket contacts (15, 16, 17) for receiving said plug pins and means (8) in said plug and socket portions for moving said plug and socket portions (2, 3) relative to one another into the coupled and uncoupled positions and for locking them in the coupled position, and a slide safety mechanism (23) located within said socket portion (3) which can be moved during coupling from a position closing said socket contacts into a position opening the socket contacts for receiving said pins, wherein the improvement comprises that complementary interengaging ends (12, 13 and 21, 22) of low voltage control lines are integrated in said plug and socket portions (2, 3), said plug portion (2) including a grounding pin (11) and said ends in said plug portion comprising a pair of control pins, said socket contacts in said socket portion (3) comprises first contact sleeves (15–17) corresponding in number to said plug pins and arranged to receive said plug pins therein, a second contact sleeve (20) for receiving said grounding pin (11) therein, and two third contact sleeves (21, 22) for receiving said control pins (12, 13) therein, said means (8) comprises a threaded bolt (9) in one of said plug portion (2) and socket portion (3) and a corresponding threaded sleeve (10) in the other one of said plug portion (2) and socket portion (3) so that by moving said threaded bolt into said threaded sleeve, said plug pins, grounding pin and control pins are moved in said first contact sleeves, second contact sleeve and third contact sleeves respectively, for effecting the connection of said device and the geometrical dimensions of the intergaged said plug, grounding and control pins and the corresponding said first, second and third contact sleeves being selected so that initially said grounding pin enters said second contact sleeve, followed by said plug pins entering said first contact sleeves and then by said control pins entering said third contact sleeves, a first control surface (25) in said plug portion (2), a second control surface (24) on said slide safety mechanism aligned with said first control surface so that said slide safety mechanism (23) is moved into the position opening said socket contacts by the contact of said first control surface (25) with said second control surface (24) for facilitating the coupling connection of said plug portion (2) and said socket portion (3).

2. Device according to claim 1, wherein said plug portion (2) and said socket portion (3) each have an essentially rectangular housing laterally enclosing said plug pins, grounding pin and control pins in said plug portion and said first, second and third socket sleeves in said socket portion, said plug pins, grounding pin and control pins are aligned laterally in a row with the one of said threaded bolt (9) and said threaded sleeve (10) within said plug portion (2) centered in said row between said plug pins on one side and said grounding pin and said control pins on the other side.

3. Device according to claim 1, wherein said plug portion including a housing wall (14) laterally enclosing said plug pins, grounding pin and control pins, said first control surface (25) is provided on a portion of the housing wall (14) projecting beyond said plug pins (5, 6, 7) of said plug portion (2), said socket portion (3) including a socket housing, said housing wall (14) arranged to slidably contact the inside surface of said socket housing, so that, after said housing wall has engaged in the socket housing (3) and after said threaded bolt (9) has engaged in said threaded sleeve (10), said safety mechanism (23) is moved into the open position as a result of the further relative movement of said plug portion (2) into said socket portion (3).

4. Device according to claim 2 or 3, including electric hot plates for the thermal connection of at least two parts such as conveyor belts with said plug portion and socket portion arranged in cooperation with said hot plates for connection to an electric supply and control line, said plug portion (2′) is integrated in said hot plate (27) and a cable outlet (4) is connected to said socket portion (3) and is arranged in the region of the said first contact sleeves (15–17).

5. Device according to claim 4, characterized in that said means for moving and for locking is arranged in the center of said socket portion (3).

* * * * *